US011142389B1

(12) United States Patent
Dong

(10) Patent No.: US 11,142,389 B1
(45) Date of Patent: Oct. 12, 2021

(54) THERMAL CONTAINER

(71) Applicant: XIAMEN KINGQUEEN INDUSTRIAL CO., LTD., Fujian (CN)

(72) Inventor: Jinfei Dong, Xiamen (CN)

(73) Assignee: XIAMEN KINGQUEEN INDUSTRIAL CO., LTD., Fujian (CN)

( * ) Notice: Subject to any disclaimer, the term of this patent is extended or adjusted under 35 U.S.C. 154(b) by 0 days.

(21) Appl. No.: 16/953,367

(22) Filed: Nov. 20, 2020

(51) Int. Cl.
*B65D 81/38* (2006.01)
*B65D 43/16* (2006.01)

(52) U.S. Cl.
CPC ..... *B65D 81/3823* (2013.01); *B65D 43/163* (2013.01); *B65D 81/3816* (2013.01); *B65D 81/3818* (2013.01)

(58) Field of Classification Search
CPC ..... B65D 81/3823; B65D 41/163; B65D 43/163; B65D 81/3816; B65D 81/3818; A61J 5/0026; A61J 1/00; A45D 2200/051
USPC .... 220/592.25, 525; 206/564, 525, 524, 544
See application file for complete search history.

(56) References Cited

U.S. PATENT DOCUMENTS 2,752,970 A * 7/1956 Earls ..... B65D 43/0218 220/802
3,338,068 A * 8/1967 Piker ..... F25D 3/08 62/398
3,387,650 A * 6/1968 Masshake ..... A47J 41/0044 165/75
3,406,532 A * 10/1968 Bridges ..... F25D 3/06 62/457.2
3,807,194 A * 4/1974 Bond ..... A47G 23/04 62/457.4
4,050,264 A * 9/1977 Tanaka ..... F25D 3/08 62/457.2
4,213,310 A * 7/1980 Buss ..... A47J 41/0044 206/544
4,498,312 A * 2/1985 Schlosser ..... A47J 39/00 62/371
4,796,758 A * 1/1989 Hauk ..... A45C 11/20 206/545
4,958,506 A * 9/1990 Guilhem ..... A01N 1/02 62/119
5,897,017 A * 4/1999 Lantz ..... B65D 81/3823 220/592.1

(Continued)

*Primary Examiner* — J. Gregory Pickett
*Assistant Examiner* — Tia Cox
(74) *Attorney, Agent, or Firm* — Leong C. Lei

(57) ABSTRACT

A thermal container includes a cover, a main body, an opening-closing assembly, and a sealing ring. The main body is formed with a storage space. The opening-closing assembly includes an upper connecting member that is hermetically connected to the cover and a lower connecting member that is hermetically connected to an opening of the storage space. Rear ends of the upper connecting member and the lower connecting member are pivotally connected together. Front ends of the upper connecting member and the lower connecting member are provided with a locking mechanism. The lower connecting member is formed with a through hole communicating with the storage space. The upper connecting member is provided with a protruding portion matching the through hole. The sealing ring is hermetically fitted between the through hole and the protruding portion.

13 Claims, 18 Drawing Sheets

(56) References Cited

U.S. PATENT DOCUMENTS

| | | | | |
|---|---|---|---|---|
| 6,244,458 | B1 * | 6/2001 | Frysinger | B65D 81/3823 220/592.09 |
| 7,722,204 | B1 * | 5/2010 | Sandberg | F25D 27/005 362/92 |
| 8,348,510 | B2 * | 1/2013 | Mogil | B65D 81/38 383/38 |
| 9,527,652 | B2 * | 12/2016 | Furneaux | B65D 81/3823 |
| 9,878,841 | B2 * | 1/2018 | Holderness | B65D 83/00 |
| 10,676,267 | B2 * | 6/2020 | Seiders | B65B 31/04 |
| 10,766,672 | B2 * | 9/2020 | Bullock | B65D 51/165 |
| 2002/0000918 | A1 * | 1/2002 | Hunter | B65D 81/3823 340/584 |
| 2012/0318808 | A1 * | 12/2012 | McCormick | F16L 59/065 220/592.21 |
| 2014/0349273 | A1 * | 11/2014 | Anderson | C12M 45/22 435/1.2 |
| 2018/0141718 | A1 * | 5/2018 | Ahlstrom | B65D 25/2841 |
| 2018/0224178 | A1 * | 8/2018 | Sun | B65D 81/3823 |
| 2019/0152677 | A1 * | 5/2019 | Hoyt | B65D 81/3813 |
| 2019/0217999 | A1 * | 7/2019 | Wood | B65D 43/22 |
| 2020/0079575 | A1 * | 3/2020 | Kitano | B65D 81/3825 |

* cited by examiner

A-A

B-B

THERMAL CONTAINER

BACKGROUND OF THE INVENTION

1. Field of the Invention

The present invention relates to a thermal box, and more particularly to a thermal container.

2. Description of the Prior Art

Thermal containers are containers having thermal insulation properties. In our daily life, thermal boxes are widely used, especially in the fields of take-away food, medicine, scientific research, etc. for carrying articles that need to be kept in a constant temperature environment. Compared with a general storage box, the main body of a thermal box is made of special materials to attain a thermal function, so that the main body has a short-term thermal effect for storing food, medicines, samples, and the like and for maintaining the temperature and freshness of the above items.

A conventional thermal box mainly uses a zipper as the opening-closing structure to realize the opening and closing between the cover and the box. The disadvantages of using a zipper are described below. (1) A zipper itself is a soft structure. It is difficult to be shaped in the assembly process, and it is difficult to be combined with the cover/box. This will affect the production efficiency and the product yield. (2) A zipper is a device consisting of two flexible strips with metal or plastic interlocking projections closed or opened by pulling a slide along them. However, the gap between the interlocking projections is likely to cause air or liquid leakage, so the sealing performance of the product cannot meet the needs of use.

SUMMARY OF THE INVENTION

The primary object of the present invention is to provide a thermal container, which makes the assembly of the thermal container more convenient and simple, and improves the production efficiency and the product yield and the sealing performance.

In order to achieve the above object, the present invention adopts the following technical solutions.

A thermal container comprises a cover, a main body, an opening-closing assembly, and a sealing ring. The main body is formed with a storage space. The opening-closing assembly includes an upper connecting member and a lower connecting member that are made of a hard material. The upper connecting member is hermetically connected to the cover. The lower connecting member is hermetically connected to an opening of the storage space. Rear ends of the upper connecting member and the lower connecting member are pivotally connected together. Front ends of the upper connecting member and the lower connecting member are provided with a locking mechanism. The lower connecting member is formed with a through hole communicating with the storage space. The upper connecting member is provided with a protruding portion matching the through hole. The sealing ring is hermetically fitted between the through hole and the protruding portion. Preferably, the cover includes a first outer layer, a first interlayer and a first inner layer that are stacked in sequence. The upper connecting member is provided with a hollow structure passing through upper and lower surfaces of the upper connecting member. The first interlayer is fitted in the hollow structure. The first outer layer and the first inner layer are hermetically connected to the upper surface and the lower surface of the upper connecting member, respectively. The main body includes a second outer layer, a second interlayer and a second inner layer that are stacked in sequence. A lower surface of the lower connecting member is formed with an annular mounting groove. An upper end of the second interlayer is fitted in the mounting groove. The second outer layer and the second inner layer are attached to an outer side and an inner side of the second interlayer, respectively. Upper ends of the second outer layer and the second inner layer are hermetically connected to an outer side and an inner side of the mounting groove, respectively.

Preferably, the first outer layer, the first inner layer, the second outer layer and the second inner layer are made of a fabric. The fabric is formed of a composite material of a polyvinyl chloride (PVC), thermoplastic polyurethane (TPU), ethylene-vinyl acetate (EVA) or poly ethylene-vinyl acetate (PEVA) material and a textile material. The first interlayer and the second interlayer are made of a plastic material. The plastic material is formed of PE cotton, ethylene-vinyl acetate (EVA), thermoplastic rubber (TPR), foam or nitrile butadiene rubber (NBR). The sealing ring is made of PVC, TPU, TPR, rubber or silicone. The hard material is an injection moldable plastic material.

Preferably, the upper connecting member is adhered to the cover, and the lower connecting member is adhered to the main body.

Preferably, the locking mechanism includes a hook disposed on the front end of the upper connecting member and a catching portion disposed on the front end of the lower connecting member. When the upper connecting member and the lower connecting member are closed, the hook is buckled to the catching portion.

In an embodiment of the present invention, a side wall of the through hole is provided with an annular step. One side of the step, facing the protruding portion, is formed with an annular first flange. The sealing ring is fitted onto the first flange. When the upper connecting member and the lower connecting member are closed, the protruding portion is in contact with the sealing ring and compresses the sealing ring to be deformed, so as to maintain airtightness between the protruding portion and the step.

In an embodiment of the present invention, the sealing ring is fitted onto a periphery of a lower end of the protruding portion. A side wall of the through hole is provided with an annular step. One side of the step, facing the sealing ring, is formed with an annular first flange opposite to the sealing ring. When the upper connecting member and the lower connecting member are closed, the first flange is in contact with the sealing ring and compresses the sealing ring to be deformed, so as to maintain airtightness between the protruding portion and the step.

Preferably, the periphery of the lower end of the protruding portion is formed with a first sealing ring groove for receiving the sealing ring, and the sealing ring is adhered to the first sealing ring groove.

In an embodiment of the present invention, the sealing ring is fitted onto a side wall of the protruding portion. When the upper connecting member and the lower connecting member are closed, a side wall of the through hole is in contact with the sealing ring and compresses the sealing ring to be deformed, so as to maintain airtightness between the protruding portion and the through hole.

Preferably, the side wall of the protruding portion is formed with a second sealing ring groove, and the sealing ring is adhered to the second sealing ring groove.

Preferably, the side wall of the through hole is provided with an annular second flange opposite to the second sealing ring groove. When the upper connecting member and the lower connecting member are closed, the second flange compresses the sealing ring toward the second sealing ring groove. The second flange has a smooth curved surface.

In an embodiment of the present invention, the sealing ring is fitted onto a side wall of the through hole. When the upper connecting member and the lower connecting member are closed, a side wall of the protruding portion is in contact with the sealing ring and compresses the sealing ring to be deformed, so as to maintain airtightness between the protruding portion and the through hole.

Preferably, the side wall of the through hole is formed with a third sealing ring groove, and the sealing ring is adhered to the third sealing ring groove.

Preferably, the side wall of the protruding portion is provided with an annular third flange opposite to the third sealing ring groove. When the upper connecting member and the lower connecting member are closed, the third flange compresses the sealing ring toward the third sealing ring groove. The third flange has a smooth curved surface.

By adopting the above solutions, in the present invention, the upper connecting member and the lower connecting member made of a hard material serve as the frame of the thermal container. In the production process, the upper connecting member and the lower connecting member have a fixed shape due to their rigid characteristics, enabling the upper connecting member and the lower connecting member to be easily combined with the cover and the main body that are made of a soft material. The production process is more convenient and simple, which can improve production efficiency, product yield and sealing performance. Besides, the sealing ring is configured to maintain airtightness between the protruding portion and the side wall of the through hole to ensure the sealing effect of the thermal container after assembly. When the upper connecting member and the lower connecting member are closed, the sealing ring is compressed and deformed between the protruding portion and the through hole to ensure good sealing performance.

DETAILED DESCRIPTION OF THE PREFERRED EMBODIMENTS

Figure 1:
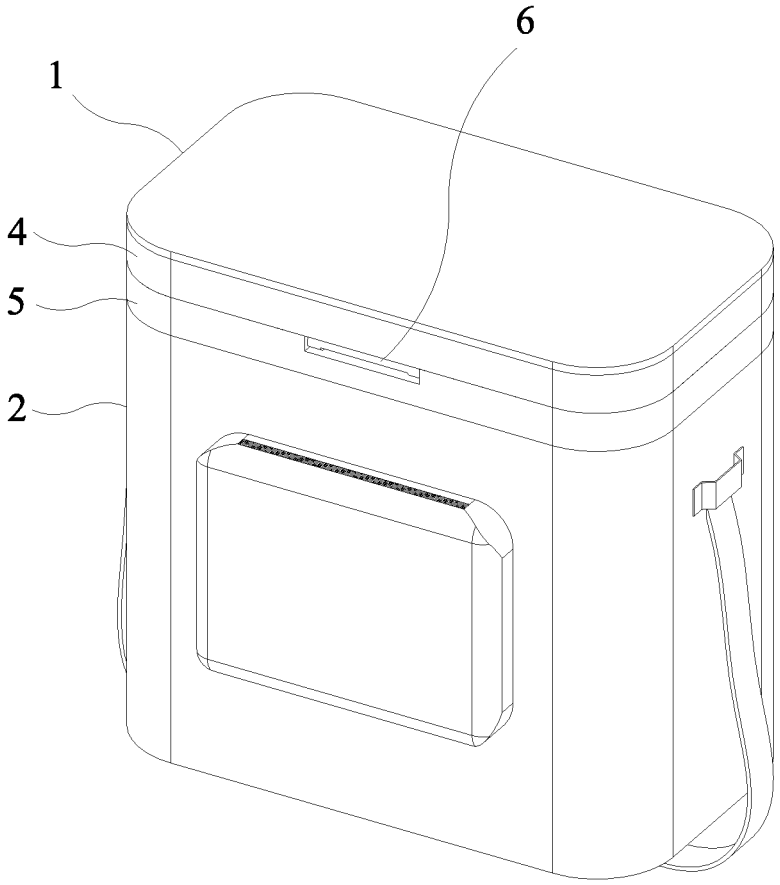
FIG. 1 is a perspective view of a preferred embodiment of the present invention in a closed state.
Figure 2:
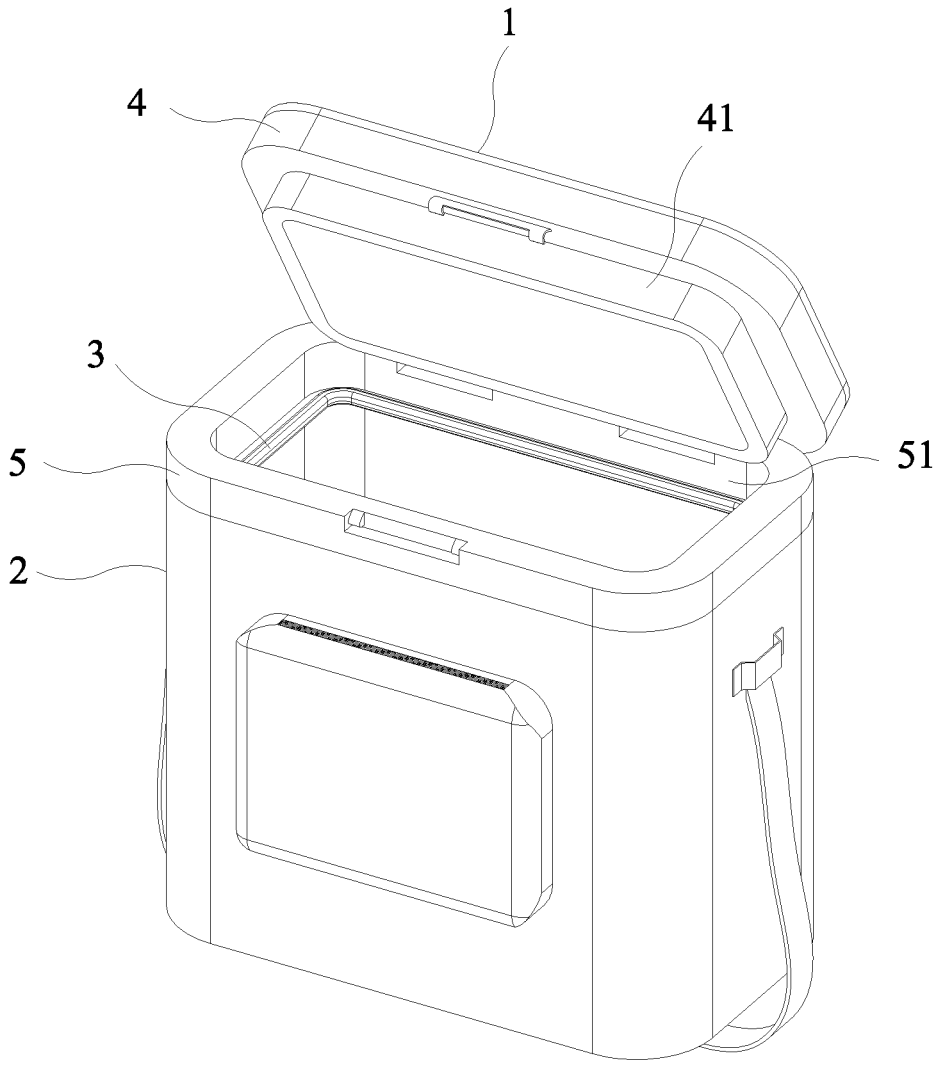
FIG. 2 is a perspective view of the preferred embodiment of the present invention in an open state.
Figure 3:
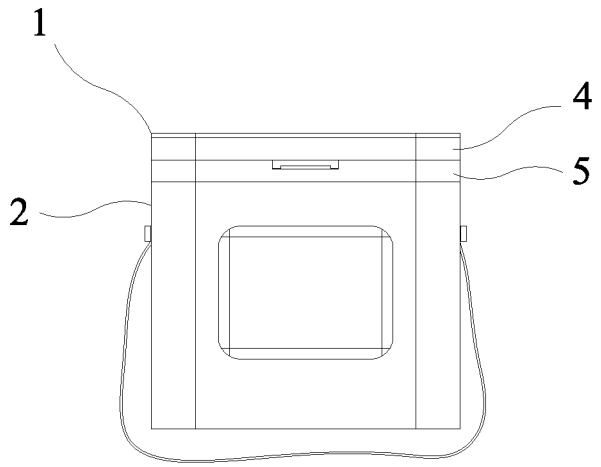
FIG. 3 is a front view of the preferred embodiment of the present invention.
Figure 4:
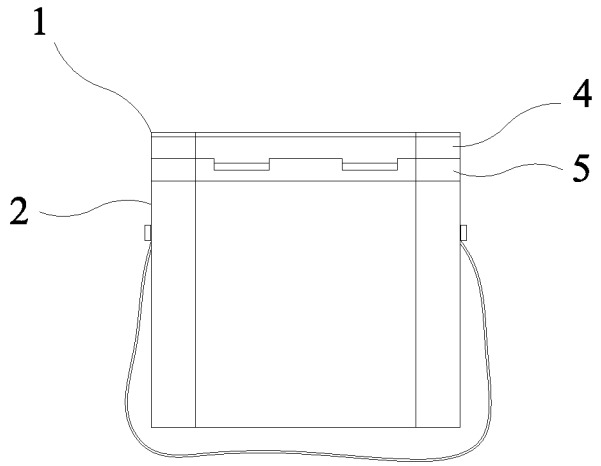
FIG. 4 is a rear view of the preferred embodiment of the present invention.
Figure 5:
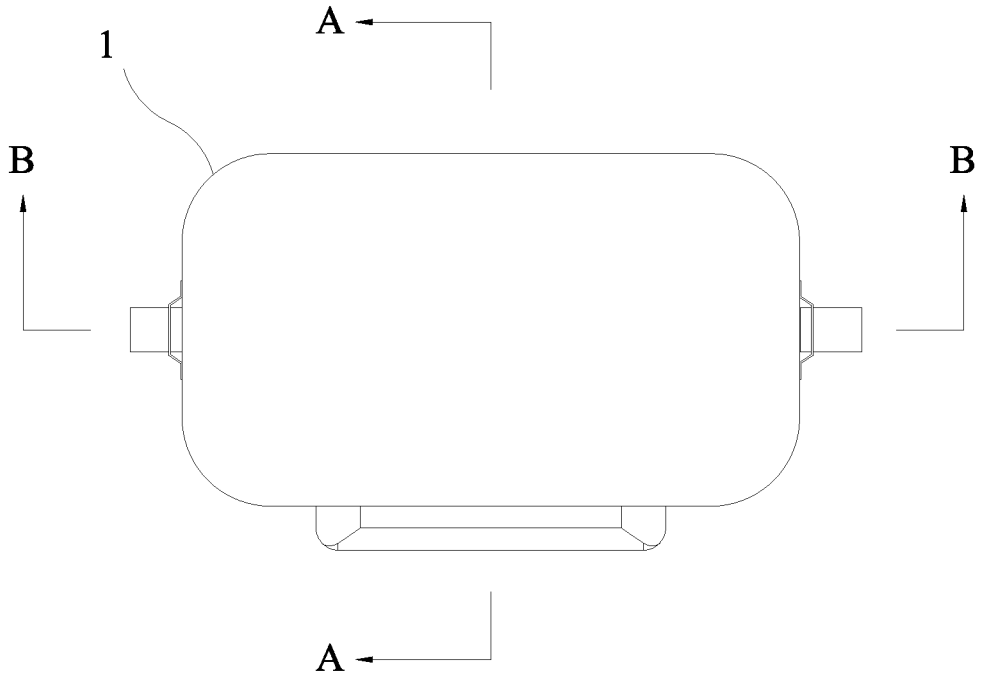
FIG. 5 is a top view of the preferred embodiment of the present invention.
Figure 6:
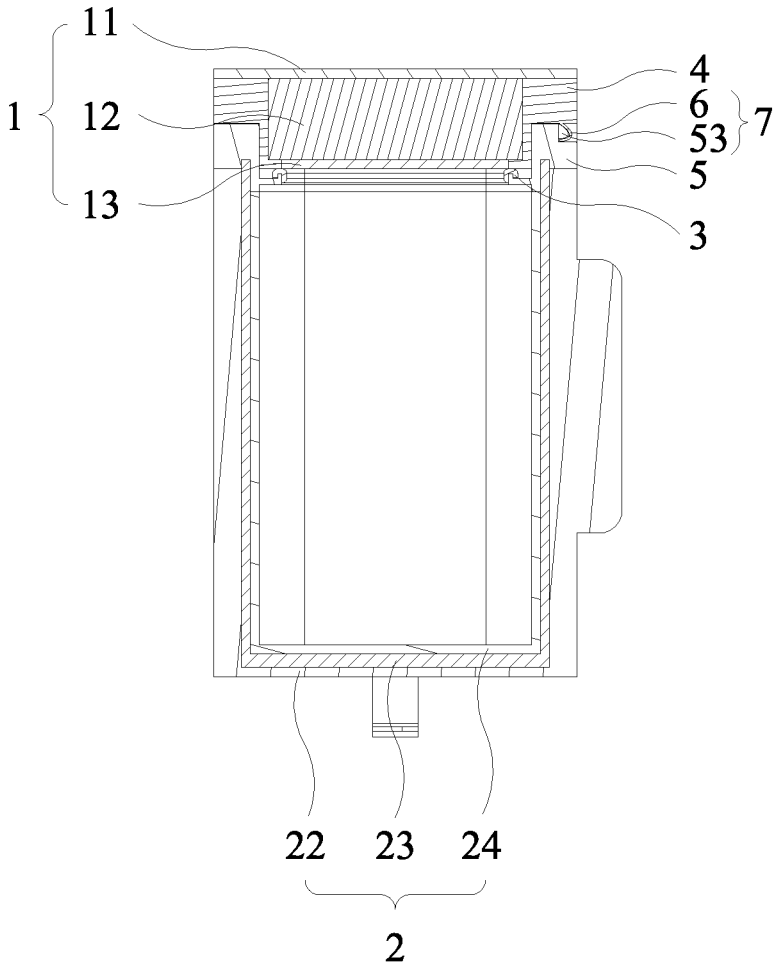
FIG. 6 is a cross-sectional view taken along line A-A of FIG. 5.
Figure 7:
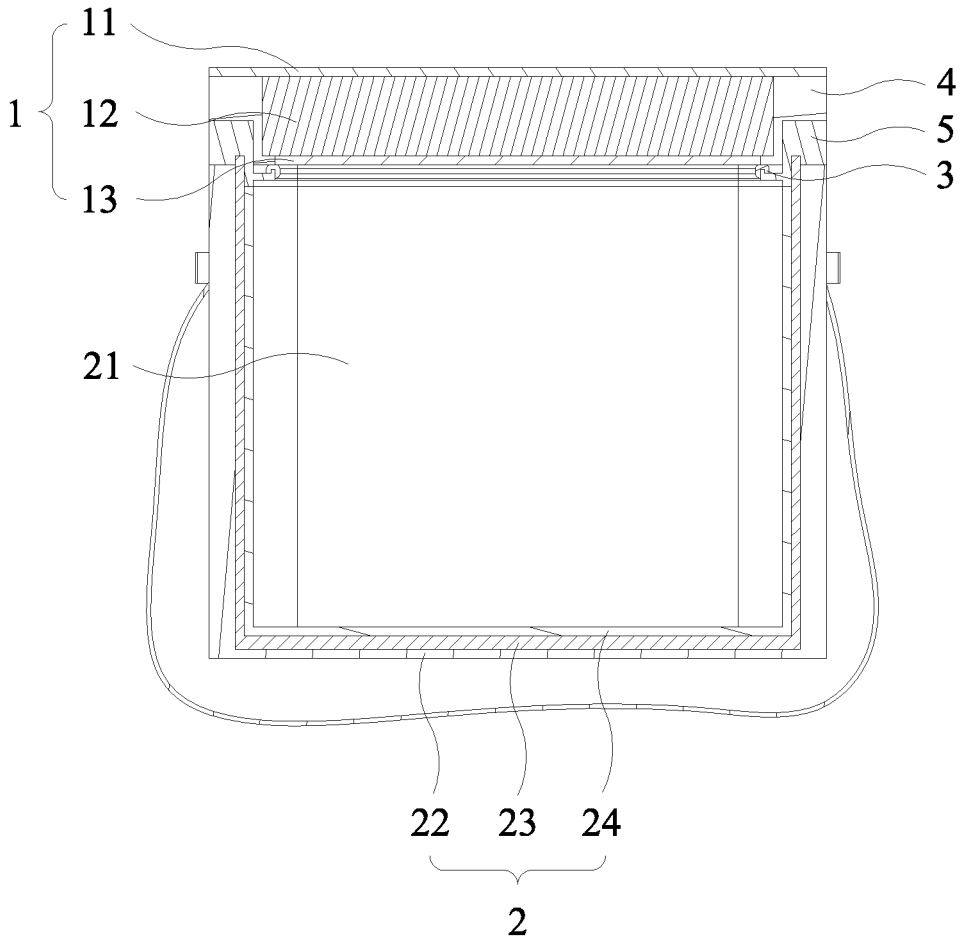
FIG. 7 is a cross-sectional view taken along line B-B of FIG. 5.

Embodiments of the present invention will now be described, by way of example only, with reference to the accompanying drawings.

As shown in FIG. 1 through FIG. 19, the present invention discloses a thermal container, comprising a cover 1, a main body 2, an opening-closing assembly, and a sealing ring 3.

The main body 2 is formed with a storage space 21.

The opening-closing assembly includes an upper connecting member 4 and a lower connecting member 5 that are made of a hard material. The upper connecting member 4 is hermetically connected to the cover 1. The lower connecting member 5 is hermetically connected to an opening of the storage space 21. The rear ends of the upper connecting member 4 and the lower connecting member 5 are pivotally connected together. The front ends of the upper connecting member 4 and the lower connecting member 5 are provided with a locking mechanism 7. The lower connecting member 5 is formed with a through hole 51 communicating with the storage space 21. The upper connecting member 4 is provided with a protruding portion 41 matching the through hole 51. The sealing ring 3 is hermetically fitted between the through hole 51 and the protruding portion 41.

FIGS. 1 to 7 show an embodiment of the present invention.

The upper connecting member 4 and the lower connecting member 5 may be pivoted through a rotating shaft, or may be pivoted through a hinge, depending on the actual needs.

The cover 1 includes a first outer layer 11, a first interlayer 12 and a first inner layer 13 that are stacked in sequence. The upper connecting member 4 is provided with a hollow structure 42 passing through the upper and lower surfaces of the upper connecting member 4. The first interlayer 12 is fitted in the hollow structure 42. The first outer layer 11 and the first inner layer 13 are hermetically connected to the upper surface and the lower surface of the upper connecting member 4, respectively.

The main body 2 includes a second outer layer 22, a second interlayer 23 and a second inner layer 24 that are stacked in sequence. The lower surface of the lower connecting member 5 is formed with an annular mounting groove 52. The upper end of the second interlayer 23 is fitted in the mounting groove 52. The second outer layer 22 and the second inner layer 24 are attached to the outer side and the inner side of the second interlayer 23, respectively. The upper ends of the second outer layer 22 and the second inner layer 24 are hermetically connected to the outer side and the inner side of the mounting groove 52, respectively.

The first outer layer 11, the first inner layer 13, the second outer layer 22 and the second inner layer 24 are all made of a fabric. The fabric is formed of a composite material of a polyvinyl chloride (PVC), thermoplastic polyurethane (TPU), ethylene-vinyl acetate (EVA) or poly ethylene-vinyl acetate (PEVA) material and a textile material. Both the first interlayer 12 and the second interlayer 23 are made of a plastic material. The plastic material is formed of a material having thermal insulation properties, such as PE cotton, ethylene-vinyl acetate (EVA), thermoplastic rubber (TPR), foam or nitrile butadiene rubber (NBR). The sealing ring 3 is made of PVC, TPU, TPR, rubber or silicone.

The upper connecting member 4 is adhered to the cover 1, and the lower connecting member 5 is adhered to the main body 2, so as to achieve a sealed connection.

The locking mechanism 7 includes a hook 6 disposed on the front end of the upper connecting member 4 and a catching portion 53 disposed on the front end of the lower connecting member 5. When the upper connecting member 4 and the lower connecting member 5 are closed, the hook 6 is buckled to the catching portion 53, so that the front end of the upper connecting member 4 is fastened to the front end of the lower connecting member 5. In this embodiment, the hook 6 is pivotally connected to the front end of the upper connecting member 4. The front end of the lower connecting member 5 is formed with a recess 54. The catching portion 53 is disposed in the recess 54. After the upper connecting member 4 and the lower connecting member 5 are closed, the hook 6 is located in the recess 54 and will not extend beyond the front ends of the upper connecting member 4 and the lower connecting member 5, keeping the front ends of the upper connecting member 4 and the lower connecting member 5 flat. That is, the surface of the thermal container is flat.

The hard material is an injection moldable plastic material.

In practical applications, the main body 2 is generally made into the shape of a box or bag. Of course, in the present invention, the thermal container may be designed into two separate parts or other forms.

Figure 8:
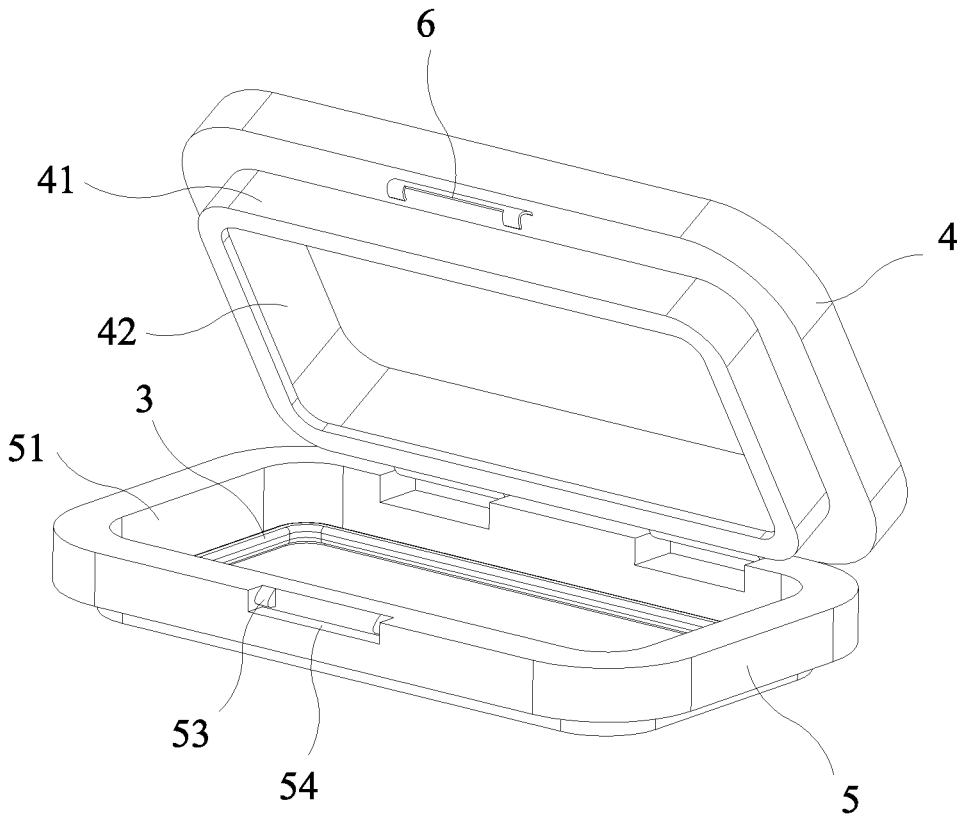
FIG. 8 is a perspective view of a first exemplary implementation of the opening-closing assembly of the present invention.
Figure 9:
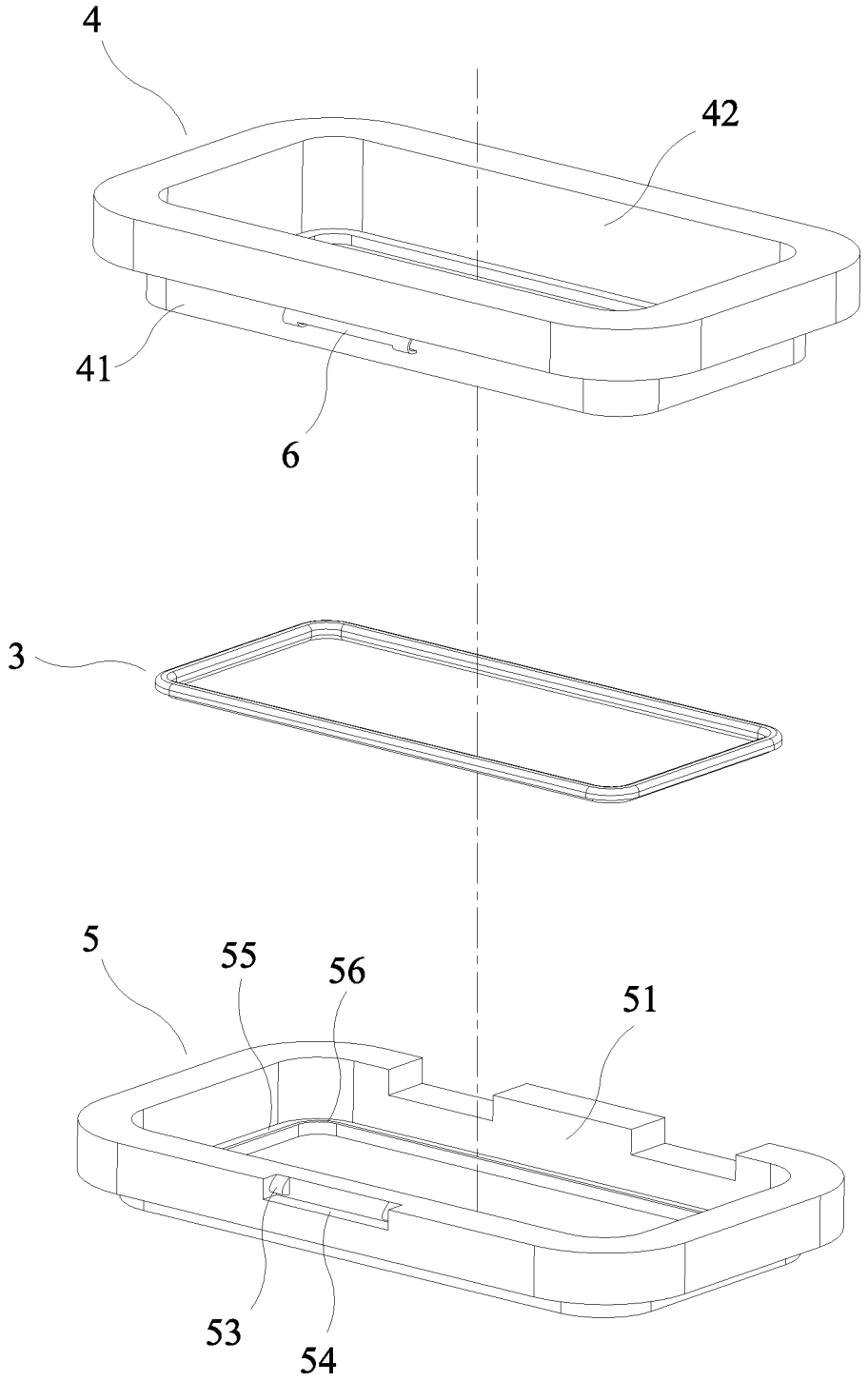
FIG. 9 is an exploded view of the first exemplary implementation of the opening-closing assembly of the present invention.
Figure 10:
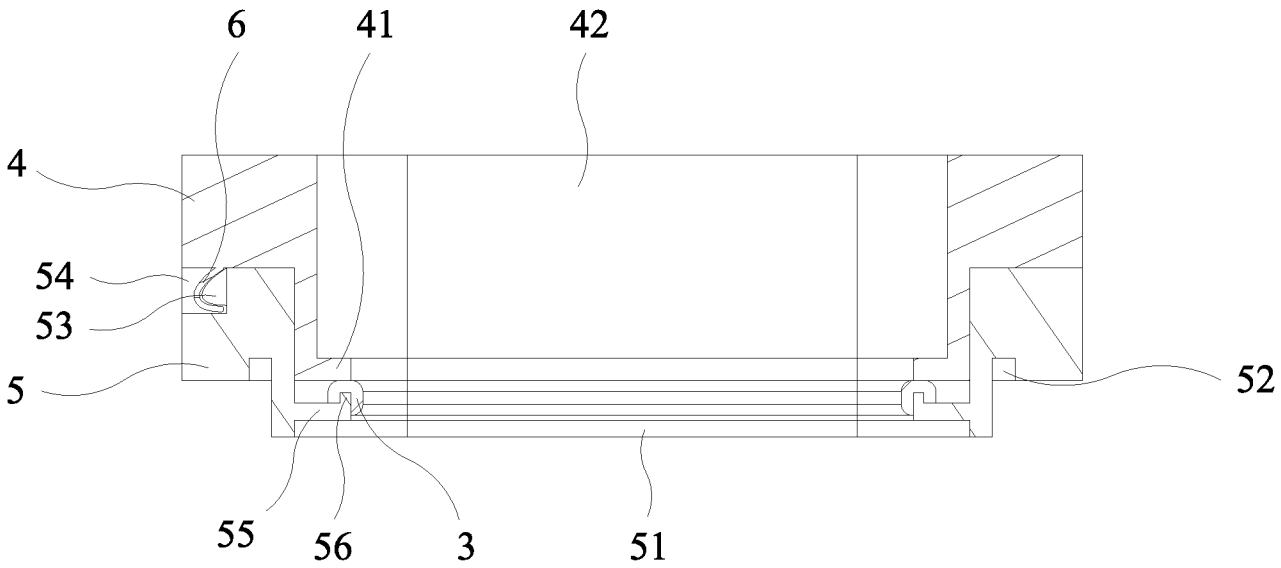
FIG. 10 is a cross-sectional view of the first exemplary implementation of the opening-closing assembly of the present invention.

FIGS. 8 to 10 show a first exemplary implementation of the opening-closing assembly of the present invention.

The side wall of the through hole 51 is provided with an annular step 55. One side of the step 55, facing the protruding portion 41, is formed with an annular first flange 56. The sealing ring 3 is fitted onto the first flange 56. When the upper connecting member 4 and the lower connecting member 5 are closed, the protruding portion 41 is in contact with the sealing ring 3 and compresses the sealing ring 3 to be deformed, so as to maintain airtightness between the protruding portion 41 and the step 55. The sealing ring 3 is secured on the first flange 56 of the step 55. The sealing ring 3 is not easy to loose when the opening-closing assembly is closed or opened. The first flange 56 abuts on the sealing ring 3 to deform the sealing ring 3, and the stressed area is small. The sealing ring 3 is more fully deformed and has a better sealing effect.

The sealing ring 3 has a C-shaped cross-section. The sealing ring 3 covers the upper surface and both side surfaces of the first flange 56. In the first exemplary implementation, the sealing ring 3 is adhered to the first flange 56.

Figure 11:
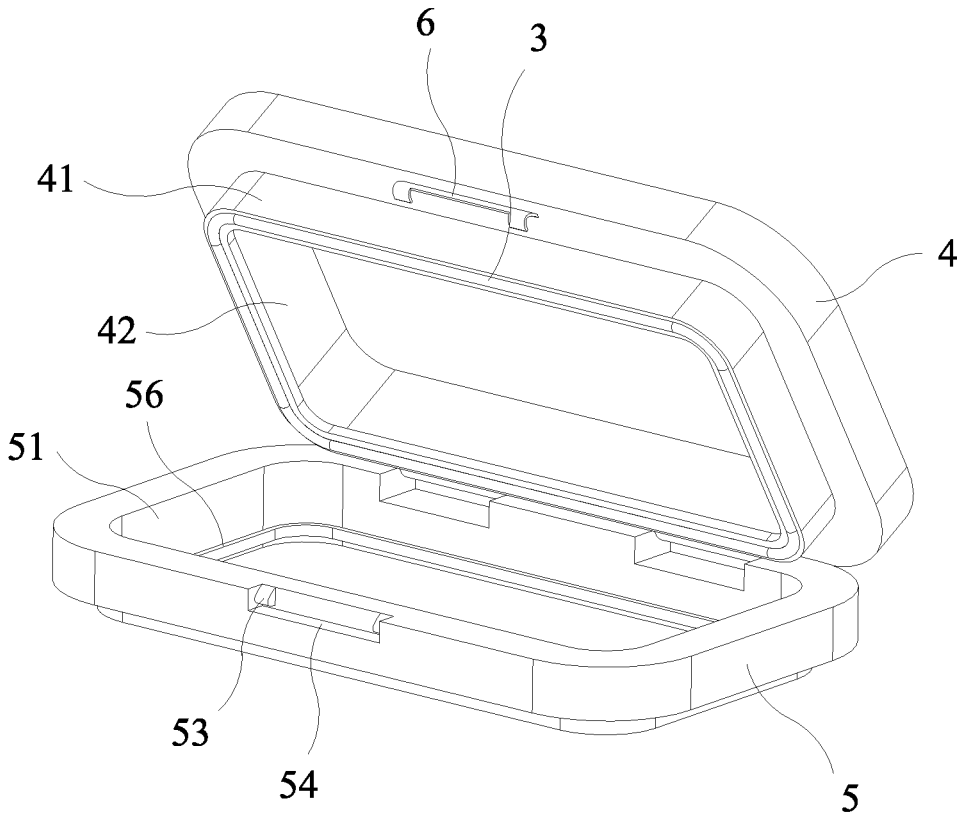
FIG. 11 is a perspective view of a second exemplary implementation of the opening-closing assembly of the present invention.
Figure 12:
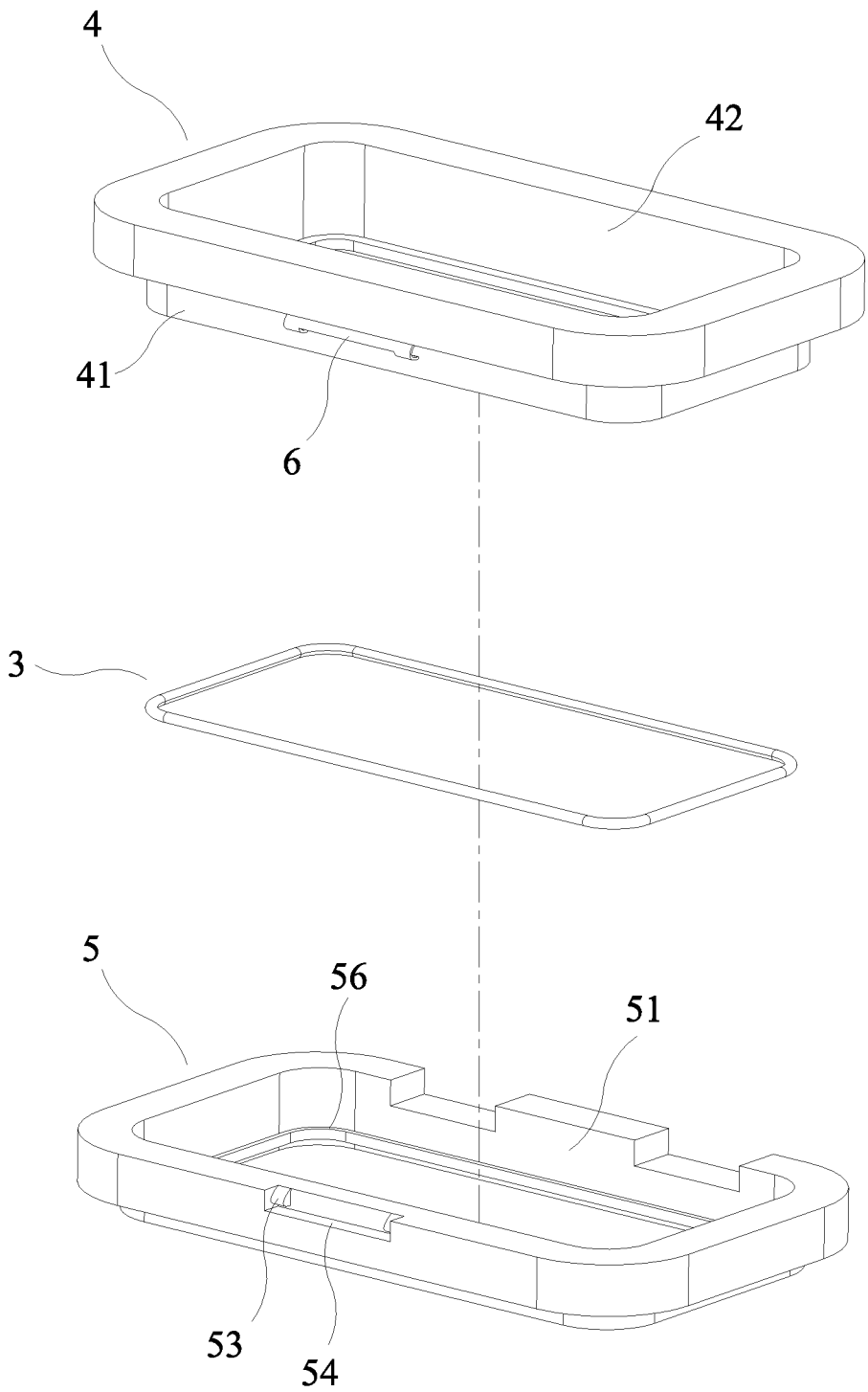
FIG. 12 is an exploded view of the second exemplary implementation of the opening-closing assembly of the present invention.
Figure 13:
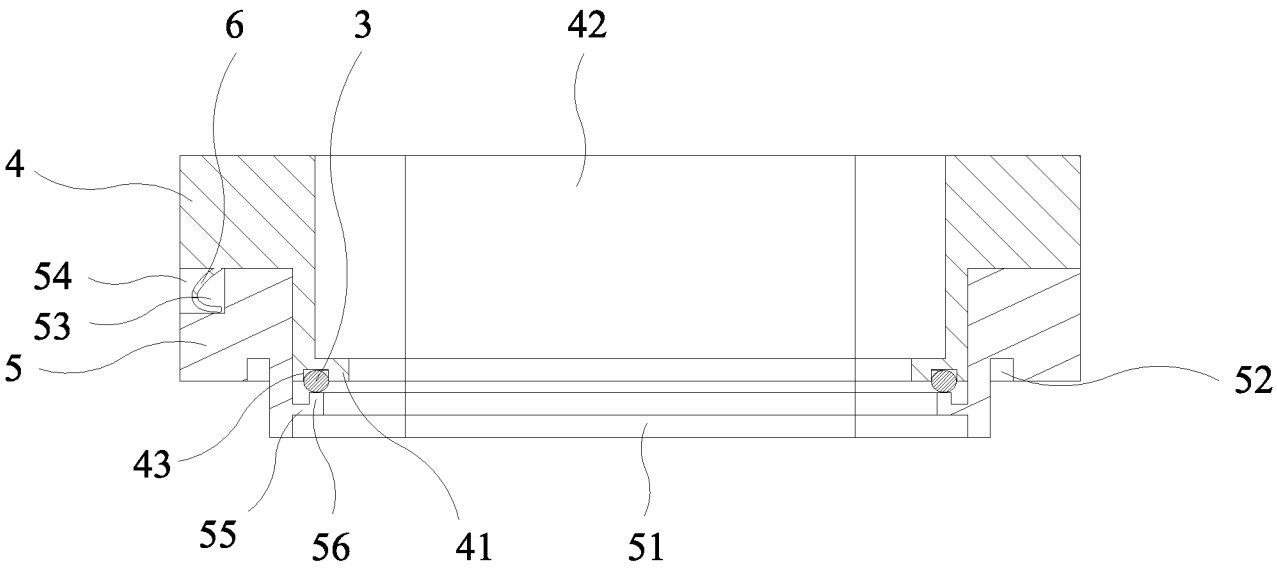
FIG. 13 is a cross-sectional view of the second exemplary implementation of the opening-closing assembly of the present invention.

FIGS. 11 to 13 show a second exemplary implementation of the opening-closing assembly of the present invention.

The sealing ring 3 is fitted onto the periphery of the lower end of the protruding portion 41. The side wall of the through hole 51 is provided with an annular step 55. One side of the step 55, facing the sealing ring 3, is formed with an annular first flange 56 opposite to the sealing ring 3. When the upper connecting member 4 and the lower connecting member 5 are closed, the first flange 56 is in contact with the sealing ring 3 and compresses the sealing ring 3 to be deformed, so as to maintain airtightness between the protruding portion 41 and the step 55. The sealing ring 3 is fitted onto the lower end of the protruding portion 41 and moves along with the protruding portion 41, which is more convenient for replacement. The first flange 56 abuts on the sealing ring 3 to deform the sealing ring 3, and the stressed area is small. The sealing ring 3 is more fully deformed and has a better sealing effect.

The periphery of the lower end of the protruding portion 41 is formed with a first sealing ring groove 43 for receiving the sealing ring 3. In the second exemplary implementation, the sealing ring 3 is adhered to the first sealing ring groove 43, or the sealing ring 3 can be inserted into the first sealing ring groove 43 in a tight-fitting manner and not falling off.

Figure 14:
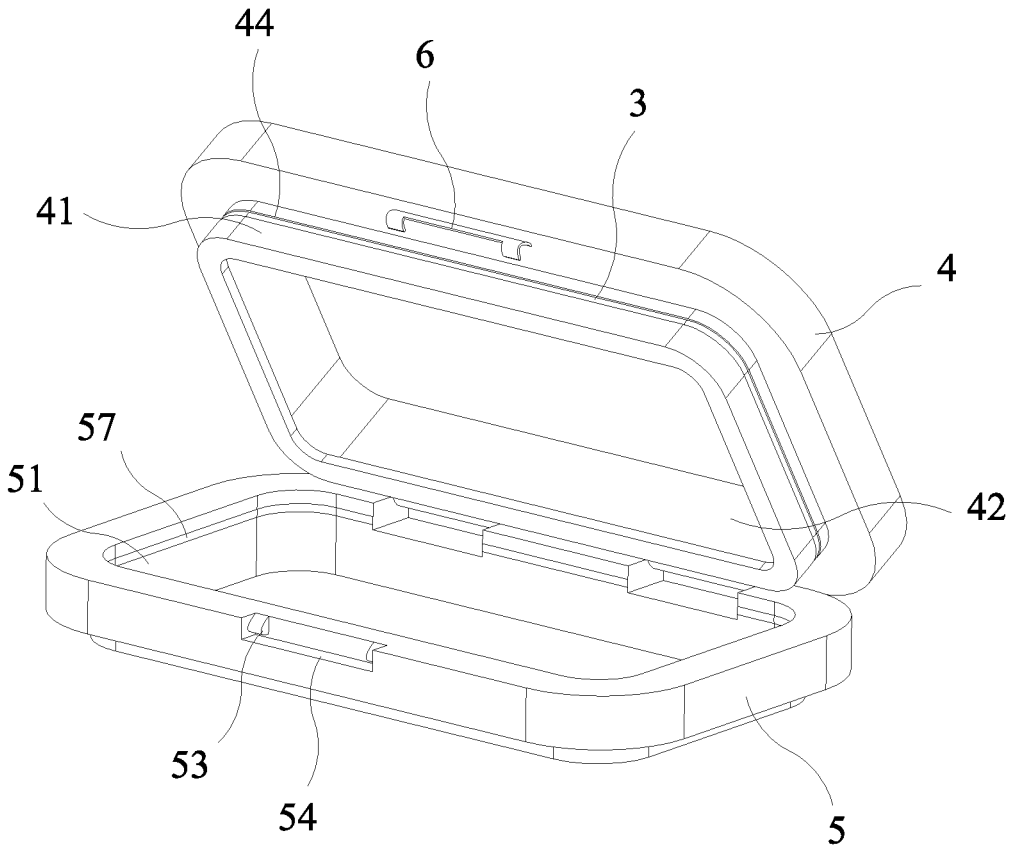
FIG. 14 is a perspective view of a third exemplary implementation of the opening-closing assembly of the present invention.
Figure 15:
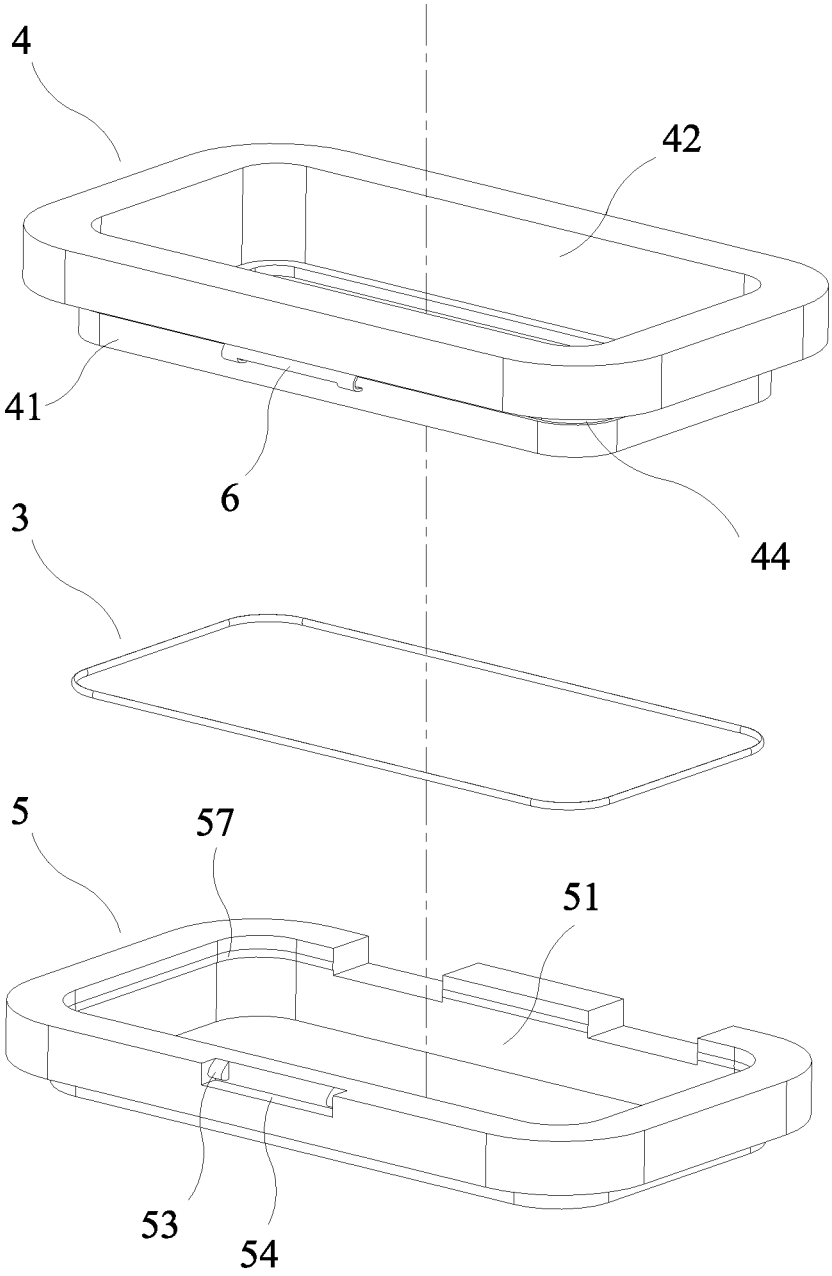
FIG. 15 is an exploded view of the third exemplary implementation of the opening-closing assembly of the present invention.
Figure 16:
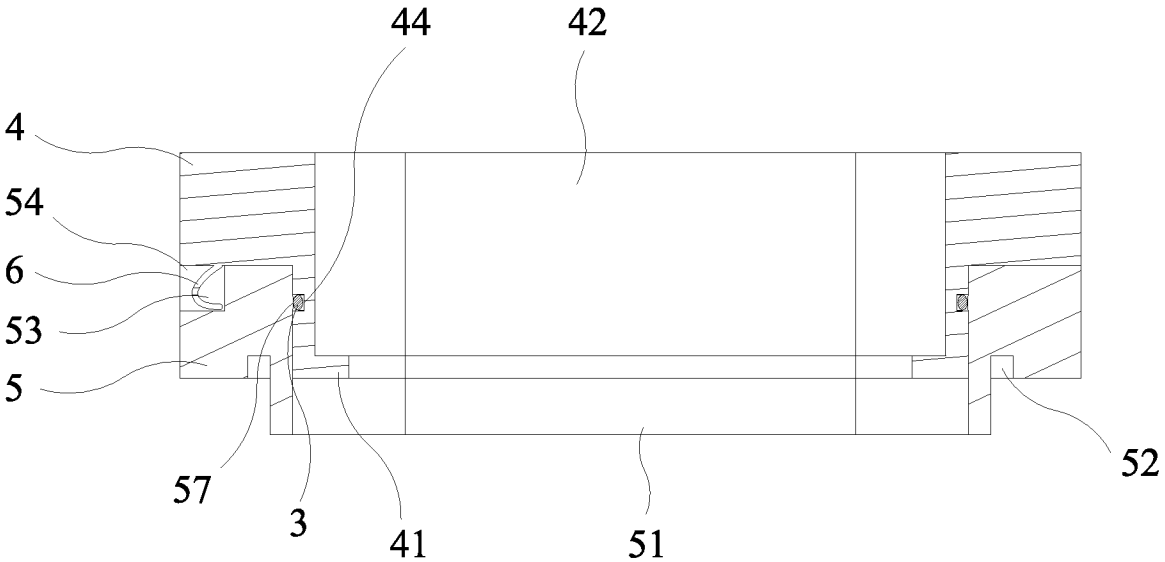
FIG. 16 is a cross-sectional view of the third exemplary implementation of the opening-closing assembly of the present invention.

FIGS. 14 to 16 show a third exemplary implementation of the opening-closing assembly of the present invention.

The sealing ring 3 is fitted onto the side wall of the protruding portion 41. When the upper connecting member 4 and the lower connecting member 5 are closed, the side wall of the through hole 51 is in contact with the sealing ring 3 and compresses the sealing ring 3 to be deformed, so as to maintain airtightness between the protruding portion 41 and the through hole 51. The sealing ring 3 is in the form of an annular sleeve to be fitted onto the side wall of the protruding portion 41. The elastic force of the sealing ring 3 can ensure that it is tightly fitted onto the protruding portion 41, thereby preventing the sealing ring 3 from moving to affect the sealing effect.

The side wall of the protruding portion 41 is formed with a second sealing ring groove 44. The sealing ring 3 is fitted in the second sealing ring groove 44. In the third exemplary implementation, the sealing ring 3 is adhered to the second sealing ring groove 44, or the sealing ring 3 can be inserted into the second sealing ring groove 44 in a tight-fitting manner. Since the sealing ring 3 is annularly sleeved onto the outer side wall of the protruding portion 41, it is sufficient to prevent it from falling.

The side wall of the through hole 51 is provided with an annular second flange 57 opposite to the second sealing ring groove 44. When the upper connecting member 4 and the lower connecting member 5 are closed, the second flange 57 compresses the sealing ring 3 toward the second sealing ring groove 44 to achieve a better sealing effect. In the third exemplary implementation, the second flange 57 has a smooth curved surface. This can avoid interference when closing/opening the protruding portion 41. It is convenient for the user to operate the thermal container.

Figure 17:
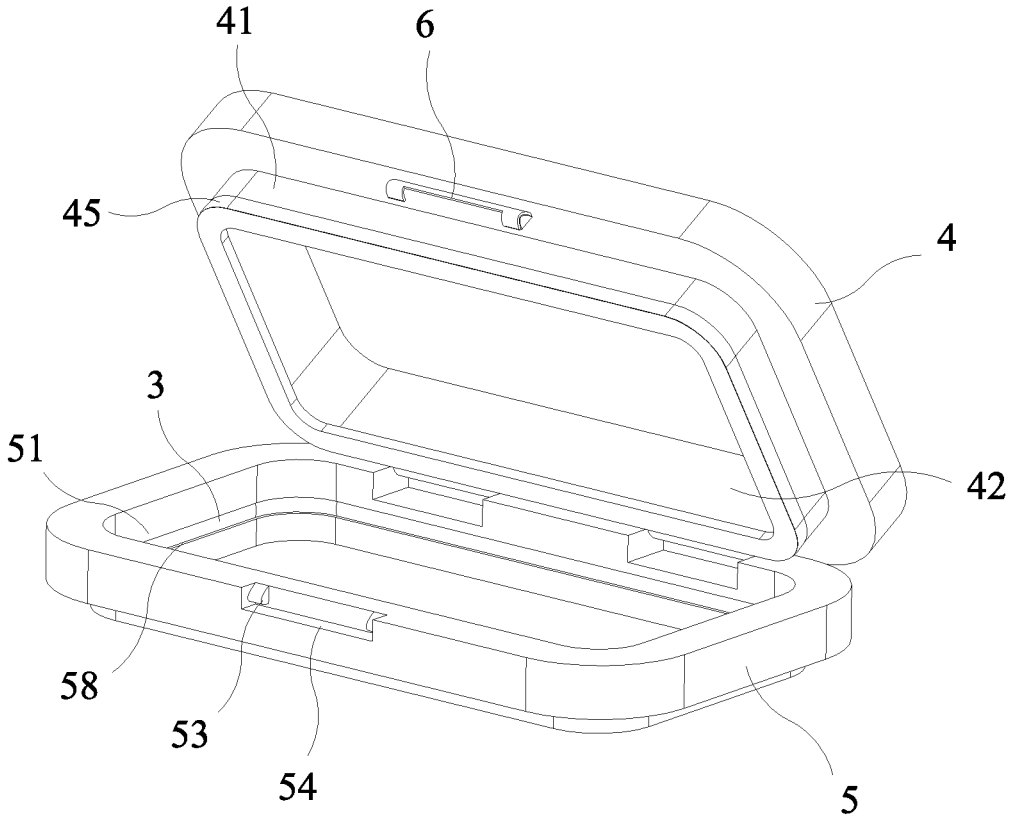
FIG. 17 is a perspective view of a fourth exemplary implementation of the opening-closing assembly of the present invention.
Figure 18:
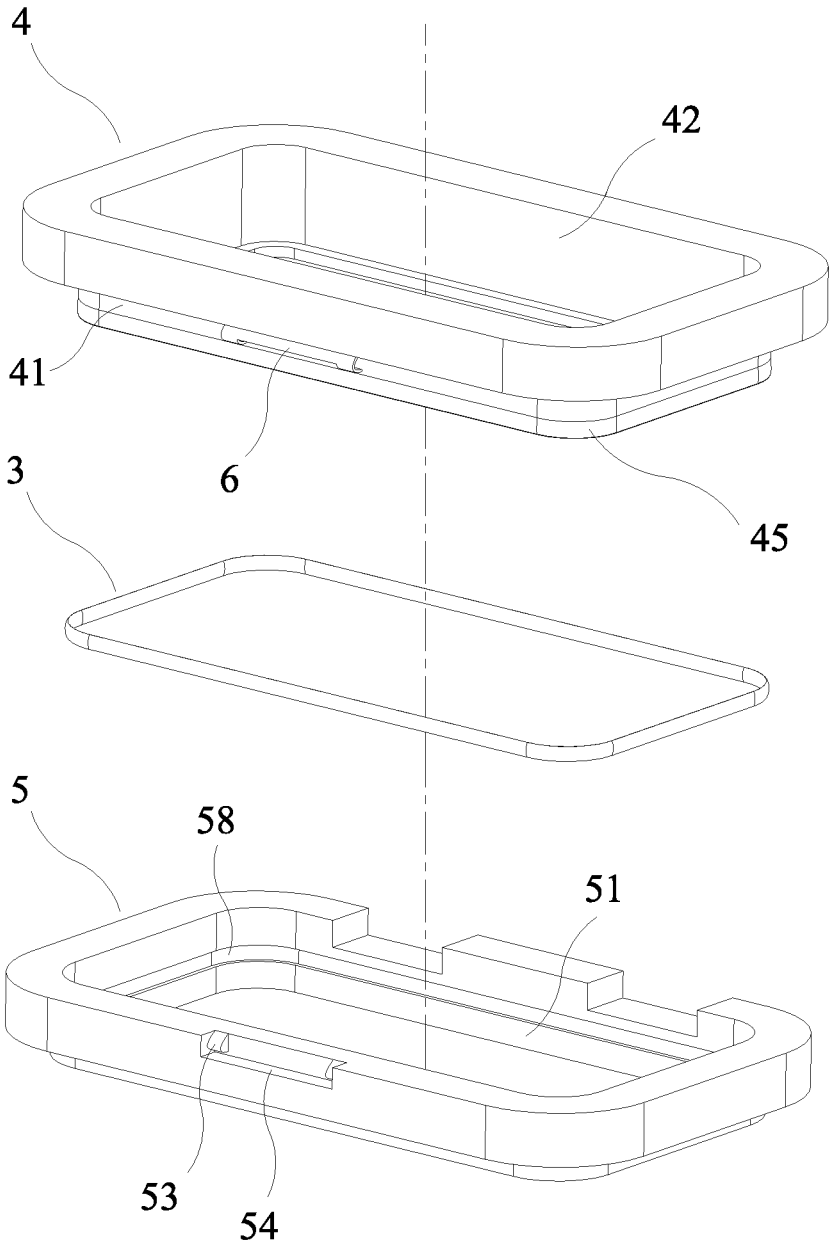
FIG. 18 is an exploded view of the fourth exemplary implementation of the opening-closing assembly of the present invention.
Figure 19:
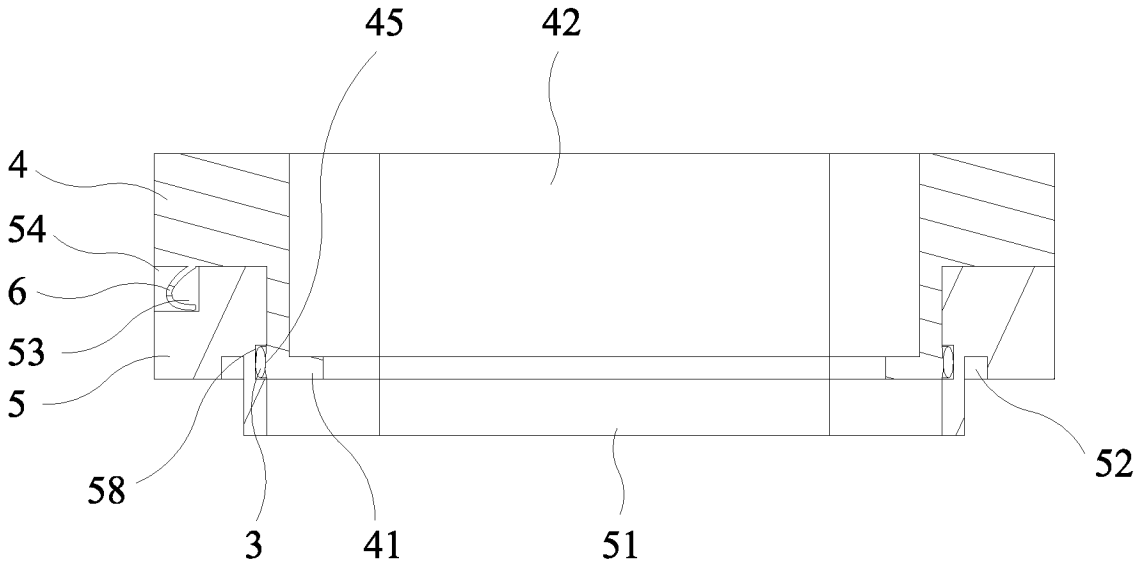
FIG. 19 is a cross-sectional view of the fourth exemplary implementation of the opening-closing assembly of the present invention.

FIGS. 17 to 19 show a fourth exemplary implementation of the opening-closing assembly of the present invention.

The sealing ring 3 is fitted onto the side wall of the through hole 51. When the upper connecting member 4 and the lower connecting member 5 are closed, the side wall of the protruding portion 41 is in contact with the sealing ring 3 and compresses the sealing ring 3 to be deformed, so as to maintain airtightness between the protruding portion 41 and the through hole 51. The sealing ring 3 is fitted and secured onto the side wall of the through hole 51, which can ensure the sealing performance at the designated position.

The side wall of the through hole 51 is formed with a third sealing ring groove 58. The sealing ring 3 is fitted in the third sealing ring groove 58. In the fourth exemplary implementation, the sealing ring 3 is adhered to the third sealing ring groove 58, or the sealing ring 3 can be inserted into the third sealing ring groove 58 in a tight-fitting manner, or the wall of the third sealing ring groove 58 is provided with a structure that can retain the sealing ring 3 to prevent it from falling.

The side wall of the protruding portion 41 is provided with an annular third flange 45 opposite to the third sealing ring groove 58. When the upper connecting member 4 and the lower connecting member 5 are closed, the third flange 45 compresses the sealing ring 3 toward the third sealing ring groove 58 to achieve a better sealing effect. In the fourth exemplary implementation, the third flange 45 has a smooth curved surface. This can avoid interference when closing/opening the protruding portion 41 (the upper connecting member 4). It is convenient for the user to operate the thermal container.

By adopting the above solutions, in the present invention, the upper connecting member 4 and the lower connecting member 5 made of a hard material serve as the frame of the thermal container. In the production process, the upper connecting member 4 and the lower connecting member 5 have a fixed shape due to their rigid characteristics, enabling the upper connecting member 4 and the lower connecting member 5 to be easily combined with the cover 1 and the main body 2 that are made of a soft material. The production process is more convenient and simple, which can improve production efficiency, product yield and sealing performance. Besides, the sealing ring 3 is configured to maintain airtightness between the protruding portion 41 and the side wall of the through hole 51 to ensure the sealing effect of the thermal container after assembly. When the upper connecting member 4 and the lower connecting member 5 are closed, the sealing ring 3 is compressed and deformed between the protruding portion 41 and the through hole 51 to ensure good sealing performance.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A thermal container, comprising a cover, a main body, an opening-closing assembly, and a sealing ring;

the main body being formed with a storage space;

the opening-closing assembly including an upper connecting member and a lower connecting member, the upper connecting member being hermetically connected to the cover, the lower connecting member being hermetically connected to an opening of the storage space; rear ends of the upper connecting member and the lower connecting member being pivotally connected together, front ends of the upper connecting member and the lower connecting member being provided with a locking mechanism; the lower connecting member being formed with a through hole communicating with the storage space, the upper connecting member being provided with a protruding portion matching the through hole, the sealing ring being hermetically fitted between the through hole and the protruding portion;

wherein the cover includes a first outer layer, a first interlayer and a first inner layer that are stacked in sequence, the upper connecting member is provided with a hollow structure passing through upper and lower surfaces of the upper connecting member, the first interlayer is fitted in the hollow structure, the first outer layer and the first inner layer are hermetically connected to the upper surface and the lower surface of the upper connecting member, respectively;

the main body includes a second outer layer, a second interlayer and a second inner layer that are stacked in sequence, a lower surface of the lower connecting member is formed with an annular mounting groove, an upper end of the second interlayer is fitted in the mounting groove, the second outer layer and the second inner layer are attached to an outer side and an inner side of the second interlayer respectively, and upper ends of the second outer layer and the second inner layer are hermetically connected to an outer side and an inner side of the mounting groove, respectively.

2. The thermal container as claimed in claim 1, wherein the first outer layer, the first inner layer, the second outer layer and the second inner layer are made of a fabric, the fabric is formed of a composite material of a polyvinyl chloride (PVC), thermoplastic polyurethane (TPU), ethylene-vinyl acetate (EVA) or poly ethylene-vinyl acetate (PEVA) material and a textile material; the first interlayer and the second interlayer are made of a plastic material, the plastic material is formed of PE cotton, ethylene-vinyl acetate (EVA), thermoplastic rubber (TPR), foam or nitrile butadiene rubber (NBR); the sealing ring is made of PVC, TPU, TPR, rubber or silicone; and the hard material is an injection moldable plastic material.

3. The thermal container as claimed in claim 1, wherein the upper connecting member is adhered to the cover, and the lower connecting member is adhered to the main body.

4. The thermal container as claimed in claim 1, wherein the locking mechanism includes a hook disposed on the front end of the upper connecting member and a catching portion disposed on the front end of the lower connecting member, when the upper connecting member and the lower connecting member are closed, the hook is buckled to the catching portion.

5. The thermal container as claimed in claim 1, wherein a side wall of the through hole is provided with an annular step, one side of the step, facing the protruding portion, is formed with an annular first flange, the sealing ring is fitted onto the first flange; when the upper connecting member and the lower connecting member are closed, the protruding portion is in contact with the sealing ring and compresses the sealing ring to be deformed, so as to maintain airtightness between the protruding portion and the step.

6. The thermal container as claimed in claim 1, wherein the sealing ring is fitted onto a periphery of a lower end of the protruding portion, a side wall of the through hole is provided with an annular step, one side of the step, facing the sealing ring, is formed with an annular first flange opposite to the sealing ring; when the upper connecting member and the lower connecting member are closed, the first flange is in contact with the sealing ring and compresses the sealing ring to be deformed, so as to maintain airtightness between the protruding portion and the step.

7. The thermal container as claimed in claim 6, wherein the periphery of the lower end of the protruding portion is formed with a first sealing ring groove for receiving the sealing ring, and the sealing ring is adhered to the first sealing ring groove.

8. The thermal container as claimed in claim 1, wherein the sealing ring is fitted onto a side wall of the protruding portion; when the upper connecting member and the lower connecting member are closed, a side wall of the through hole is in contact with the sealing ring and compresses the sealing ring to be deformed, so as to maintain airtightness between the protruding portion and the through hole.

9. The thermal container as claimed in claim 8, wherein the side wall of the protruding portion is formed with a second sealing ring groove, and the sealing ring is adhered to the second sealing ring groove.

10. The thermal container as claimed in claim 8, wherein the side wall of the through hole is provided with an annular second flange opposite to the second sealing ring groove, when the upper connecting member and the lower connecting member are closed, the second flange compresses the sealing ring toward the second sealing ring groove; and the second flange has a smooth curved surface.

11. The thermal container as claimed in claim 1, wherein the sealing ring is fitted onto a side wall of the through hole; when the upper connecting member and the lower connecting member are closed, a side wall of the protruding portion is in contact with the sealing ring and compresses the sealing ring to be deformed, so as to maintain airtightness between the protruding portion and the through hole.

12. The thermal container as claimed in claim 11, wherein the side wall of the through hole is formed with a third sealing ring groove, and the sealing ring is adhered to the third sealing ring groove.

13. The thermal container as claimed in claim 11, wherein the side wall of the protruding portion is provided with an annular third flange opposite to the third sealing ring groove, when the upper connecting member and the lower connecting member are closed, the third flange compresses the sealing ring toward the third sealing ring groove; and the third flange has a smooth curved surface.

* * * * *